US008425796B2

(12) United States Patent
Kaneko

(10) Patent No.: US 8,425,796 B2
(45) **Date of Patent: *Apr. 23, 2013**

(54) REFRIGERATOR OIL

(75) Inventor: Masato Kaneko, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/210,663

(22) Filed: Aug. 16, 2011

(65) Prior Publication Data

US 2011/0306532 A1 Dec. 15, 2011

Related U.S. Application Data

(60) Continuation of application No. 12/818,763, filed on Jun. 18, 2010, now Pat. No. 8,062,543, which is a division of application No. 12/093,730, filed as application No. PCT/JP2006/321894 on Nov. 1, 2006, now abandoned.

(30) Foreign Application Priority Data

Nov. 15, 2005 (JP) ..... 2005-330835

(51) Int. Cl.
*C09K 5/04* (2006.01)

(52) U.S. Cl.
USPC ..... 252/68; 62/468; 62/84; 508/579

(58) Field of Classification Search ..... 252/68; 62/468, 84; 508/579
See application file for complete search history.

(56) References Cited

U.S. PATENT DOCUMENTS

| | | | |
|---|---|---|---|
| 4,199,461 | A | 4/1980 | Olund |
| 4,800,030 | A | 1/1989 | Kaneko et al. |
| 4,983,313 | A | 1/1991 | Kaneko et al. |
| 5,032,305 | A | 7/1991 | Kamakura et al. |
| 5,295,357 | A | 3/1994 | Kaneko |
| 5,310,492 | A | 5/1994 | Seiki et al. |
| 5,403,503 | A | 4/1995 | Seiki et al. |
| 5,520,833 | A | 5/1996 | Kaneko |
| 5,648,018 | A | 7/1997 | Sabahi |
| 5,801,132 | A | 9/1998 | Kaneko et al. |
| 5,858,266 | A | 1/1999 | Kaneko |
| 5,997,761 | A | 12/1999 | Kaneko |
| 6,008,169 | A | 12/1999 | Kaneko |
| 6,074,573 | A | 6/2000 | Kaneko |
| 6,193,906 | B1 | 2/2001 | Kaneko |
| 6,197,211 | B1 | 3/2001 | Nakajima et al. |
| 6,231,782 | B1 | 5/2001 | Shimomura et al. |
| 6,261,474 | B1 | 7/2001 | Egawa et al. |
| 6,752,065 | B2 | 6/2004 | Sugioka et al. |
| 6,921,205 | B2 | 7/2005 | Kanayama et al. |
| 7,824,567 | B2 | 11/2010 | Kaneko |
| 8,062,543 | B2 * | 11/2011 | Kaneko ..... 252/68 |
| 2002/0098993 | A1 | 7/2002 | Ohsumi et al. |
| 2004/0224856 | A1 | 11/2004 | Saiki et al. |
| 2007/0213239 | A1 | 9/2007 | Kaneko |
| 2007/0272893 | A1 | 11/2007 | Kaneko |
| 2007/0290164 | A1 | 12/2007 | Kaneko |
| 2008/0108850 | A1 | 5/2008 | Nagao et al. |
| 2008/0146469 | A1 | 6/2008 | Sato et al. |
| 2009/0000331 | A1 | 1/2009 | Nagao et al. |
| 2009/0062167 | A1 | 3/2009 | Kaneko |
| 2009/0072187 | A1 | 3/2009 | Kaneko |
| 2009/0082237 | A1 | 3/2009 | Kaneko |
| 2009/0090128 | A1 | 4/2009 | Kaneko |
| 2009/0159836 | A1 | 6/2009 | Kaneko |
| 2010/0252772 | A1 | 10/2010 | Kaneko |
| 2011/0136712 | A1 | 6/2011 | Kaneko |

FOREIGN PATENT DOCUMENTS

| | | |
|---|---|---|
| EP | 1018538 | 7/2000 |
| JP | 49 13483 | 2/1974 |
| JP | 58 103594 | 6/1983 |
| JP | 58 171487 | 10/1983 |
| JP | 61 062596 | 3/1986 |
| JP | 06 184576 | 7/1994 |
| JP | 06184576 | 7/1994 |
| JP | 08 144975 | 6/1996 |
| JP | 10 147682 | 6/1998 |
| JP | 2001 294886 | 10/2001 |
| JP | 2004 526832 | 9/2004 |
| JP | 2005 155460 | 6/2005 |
| JP | 2005 213447 | 8/2005 |
| WO | WO 02/070637 | 9/2002 |

OTHER PUBLICATIONS

U.S. Appl. No. 13/315,845, filed Dec. 9, 2011, Kaneko.

* cited by examiner

*Primary Examiner* — Douglas McGinty
(74) *Attorney, Agent, or Firm* — Oblon, Spivak, McClelland, Maier & Neustadt, L.L.P.

(57) ABSTRACT

Provided is a refrigerating machine oil which contains a base oil mainly containing at least one substance selected from the group consisting of a mineral oil, a synthetic alicyclic hydrocarbon compound, and a synthetic aromatic hydrocarbon compound and having a kinematic viscosity at 40° C. of 1 to 8 $mm^2/s$. The refrigerating machine oil is applied to refrigerators including a sliding part formed of an engineering plastic or including an organic coating film or an inorganic coating film. The refrigerating machine oil enables to improve energy-saving performance due to its low viscosity, has a low frictional coefficient and good sealing property, and is suitably used in various refrigeration applications, especially in closed-type refrigerators.

12 Claims, No Drawings

REFRIGERATOR OIL

REFERENCE TO PRIOR APPLICATIONS

This application is a Continuation application of U.S. Ser. No. 12/818,763, filed Jun. 18, 2010, now U.S. Pat. No. 8,062,543; which is a Divisional application of U.S. application Ser. No. 12/093,730, filed May 15, 2008, now abandoned; which is a 371 application of PCT/JP2006/321894, filed Nov. 1, 2006; and claims priority to Japanese Application 2005-330835, filed Nov. 15, 2005, all incorporated herein by reference.

TECHNICAL FIELD

The present invention relates to a refrigerating machine oil, and more specifically, to a refrigerating machine oil, which can improve energy-saving performance due to its low viscosity, has low frictional coefficient at a sliding part and high sealing property, and is suitably used in various refrigeration applications, especially in closed-type refrigerators.

BACKGROUND ART

In general, a compression refrigerator includes at least a compressor, a condenser, an expansion mechanism (such as an expansion valve), and an evaporator, and, further, a drier, and is structured such that a mixed liquid of a refrigerant and a lubricating oil (refrigerating machine oil) circulates in a closed system. In the compression refrigerator described above, a temperature in the compressor is generally high, and a temperature in the condenser is generally low, though such a general theory is not applicable to a certain kind of the compression refrigerator. Accordingly, the refrigerant and the lubricating oil must circulate in the system without undergoing phase separation in a wide temperature range from low temperature to high temperature. In general, the refrigerant and the lubricating oil have regions where they undergo phase separation at low temperature and high temperature. Moreover, the highest temperature of the region where the refrigerant and the lubricating oil undergo phase separation at low temperature is preferably −10° C. or lower, or particularly preferably −20° C. or lower. On the other hand, the lowest temperature of the region where the refrigerant and the lubricating oil undergo phase separation at high temperature is preferably 30° C. or higher, or particularly preferably 40° C. or higher. The occurrence of the phase separation during the operation of the refrigerator adversely affects a lifetime or efficiency of the refrigerator to a remarkable extent. For example, when the phase separation of the refrigerant and the lubricating oil occurs in the compressor portion, a movable part is insufficiently lubricated, with the result that baking or the like occurs to shorten the lifetime of the refrigerator remarkably. On the other hand, when the phase separation occurs in the evaporator, the lubricating oil having a high viscosity is present, with the result that the efficiency of heat exchange reduces.

A chlorofluorocarbon (CFC), a hydrochlorofluorocarbon (HCFC), or the like has been heretofore mainly used as a refrigerant for a refrigerator. However, such compounds each contain chlorine that is responsible for environmental issues, so investigation has been conducted for a chlorine-free alternative refrigerant such as a hydrofluorocarbon (HFC). However, HFC may also be involved in global warming, so the so-called natural refrigerant such as hydrocarbon, ammonium, or carbon dioxide has been attracting attention as a refrigerant additionally suitable for environmental protection.

Because the lubricating oil for a refrigerator is used to lubricate a movable part of a refrigerator, its lubricating performance is obviously important. In particular, because an inside of a compressor becomes high temperature, viscosity that enables to retain an oil film required for lubrication is important. As for required viscosity which differs according to the type and use conditions of a compressor in use, the viscosity (kinematic viscosity) of a lubricating oil before it is mixed with a refrigerant is preferably 10 to 200 $mm^2/s$ at 40° C. It is said that when the viscosity is lower than it, an oil film becomes thin and a lubrication failure readily occurs and when the viscosity is higher than it, heat exchange efficiency lowers.

For instance, there is disclosed a lubricating oil composition for vapor compression refrigerators which uses a carbon dioxide as a refrigerant, including a lubricating oil base oil having a 10% distillation point measured by a gas chromatograph distillation method of 400° C. or higher and a 80% distillation point of 600° C. or lower, a kinematic viscosity at 100° C. of 2 to 30 $mm^2/s$, and a viscosity index of 100 or more as a main component (for example, see Patent Document 1).

The kinematic viscosity at 40° C. of the base oil used in the lubricating oil composition is in a range of 17 to 70 $mm^2/s$ in examples.

When the refrigerating machine oil having such a high viscosity is used, the large consumption of energy in a refrigerator cannot be dispensed with. Thus, investigation has been recently conducted for a reduction in viscosity of refrigerating machine oil or an improvement in frictional characteristics of the oil in lubrication with a view to saving energy consumed by a refrigerator.

The energy-saving property of, for example, a refrigerator for a refrigerator has been improved by reducing the viscosity of refrigerating machine oil to VG32, 22, 15, or 10. However, an additional reduction in viscosity has involved the emergence of problems such as reductions in sealing property and lubricity of the oil.

[Patent Document 1] Japanese Patent Application Laid-Open (kokai) No. 2001-294886

DISCLOSURE OF THE INVENTION

Problems to be Solved by the Invention

It is an object of the present invention to provide a refrigerating machine oil which can improve energy-saving performance due to its low viscosity, has low frictional coefficient at a sliding part and high sealing property, and is suitably used in various refrigeration applications, especially in closed-type refrigerators.

Means for Solving the Problems

The inventors of the present invention have conducted intensive studies to develop a refrigerating machine oil having the above preferred properties and have found that the above objects can be attained by using a base oil containing a mineral oil having a specific low viscosity, a synthetic alicyclic hydrocarbon compound, or a synthetic aromatic hydrocarbon compound as a major component, and using a specific material in the sliding part of a refrigerator. The present invention has been accomplished based on this finding.

That is, the present invention provides:

(1) a refrigerating machine oil, including a base oil which contains at least one substance selected from the group consisting of a mineral oil, a synthetic alicyclic hydrocarbon compound, and a synthetic aromatic hydrocarbon compound as a main component and has a kinematic viscosity at 40° C. of 1 to 8 $mm^2/s$, and used in a refrigerator having a sliding part formed of an engineering plastic or including an organic coating film or an inorganic coating film;

(2) the refrigerating machine oil according to the item (1), in which the base oil has a molecular weight of 140 to 660;

(3) the refrigerating machine oil according to the item (1), in which the base oil has a flash point of 100° C. or higher;

(4) the refrigerating machine oil according to the item (1), in which the synthetic alicyclic hydrocarbon compound is a compound having one or more cyclohexyl ring and 10 to 45 carbon atoms in total;

(5) the refrigerating machine oil according to the item (1), in which the synthetic aromatic hydrocarbon compound is a benzene derivative or naphthalene derivative having a linear alkyl group on an aromatic ring and 10 to 45 carbon atoms in total;

(6) the refrigerating machine oil according to the item (1), including at least one additive selected from an extreme-pressure agent, an oiliness agent, an antioxidant, an acid scavenger and an antifoaming agent;

(7) the refrigerating machine oil according to the item (1), which is used in a refrigerator using a hydrocarbon-based, carbon dioxide-based, hydrofluorocarbon-based, or ammonia-based refrigerant;

(8) the refrigerating machine oil according to the item (7), which is used in a refrigerator using a hydrocarbon-based refrigerant;

(9) the refrigerating machine oil according to the item (1), in which the organic coating film on the sliding part of the refrigerator includes a polytetrafluoroethylene coating film, a polyimide coating film, or a polyamide-imide coating film;

(10) the refrigerating machine oil according to the item (1), in which the inorganic coating film on the sliding part of the refrigerator includes a graphite film, a diamond-like carbon film, a tin film, a chromium film, a nickel film, or a molybdenum film;

(11) the refrigerating machine oil according to the item (1), which is used in a car air-conditioner, a gas heat pump, an air conditioner, a refrigerator, an automatic vending machine, a show case, a hot water supply system, or a refrigerating and heating system; and

(12) the refrigerating machine oil according to the item (11), in which a water content in the system is 60 ppm by mass or less and a residual air content therein is 8 kPa or less.

Effects of the Invention

According to the present invention, there can be provided a refrigerating machine oil which can improve energy-saving performance owing to its low viscosity, has low frictional coefficient at the sliding part and high sealing property, and is suitably used in various refrigeration applications, especially in closed-type refrigerators.

BEST MODE FOR CARRYING OUT THE INVENTION

A base oil containing at least one hydrocarbon-based base oil selected from the group consisting of a mineral oil, a synthetic alicyclic hydrocarbon compound, and a synthetic aromatic hydrocarbon compound as a major component is used in the refrigerating machine oil of the present invention. The expression "containing as a major component" herein means that the hydrocarbon-based base oil is contained in an amount of 50 mass % or more. The preferred content of the hydrocarbon-based base oil in the base oil is preferably 70 mass % or more, more preferably 90 mass % or more, much more preferably 100 mass %.

In the present invention, the kinematic viscosity at 40° C. of the base oil is 1 to 8 $mm^2/s$. When the kinematic viscosity is 1 $mm^2/s$ or more, the frictional coefficient at the sliding part is low and sealing property becomes high, and when the kinematic viscosity is 8 $mm^2/s$ or less, the effect of improving energy-saving performance is fully obtained. The kinematic viscosity at 40° C. is preferably 1 to 6 $mm^2/s$, more preferably 2 $mm^2/s$ or more and less than 5 $mm^2/s$, and particularly preferably 2.5 to 4.5 $mm^2/s$.

The molecular weight of the base oil is preferably 140 to 660, more preferably 140 to 340, and much more preferably 200 to 320. When the molecular weight falls within the above range, a desired kinematic viscosity can be obtained. The flash point is preferably 100° C. or higher, more preferably 130° C. or higher, and much more preferably 150° C. or higher. The molecular weight distribution (weight average molecular weight/number average molecular weight) of the base oil is preferably 1.5 or less, and more preferably 1.2 or less.

In the present invention, another base oil may be used in combination with the hydrocarbon-based base oil in an amount of 50 mass % or less, preferably 30 mass % or less, and more preferably 10 mass % or less if it has the above properties, but it is more preferred that the another base oil not be used.

Examples of the base oil which can be used in combination with the hydrocarbon-based base oil include hydrogenation products of an α-olefin oligomer, polyvinyl ethers, polyoxyalkylene glycol derivatives, and ether compounds.

In the present invention, a hydrocarbon-based base oil containing at least one substance selected from the group consisting of a mineral oil, a synthetic alicyclic hydrocarbon compound, and a synthetic aromatic hydrocarbon compound as a main component is used.

The mineral oil is a distillate oil obtained by distilling a paraffin group-based crude oil, intermediate group-based crude oil or naphthene group-based crude oil at normal pressure or by distilling the residual oil under reduced pressure after distillation at normal pressure, or refined oil obtained by refining the above oil in accordance with a commonly used method, exemplified by solvent refined oil, hydrogenated refined oil, dewaxed oil, and white clay processed oil.

As the synthetic alicyclic hydrocarbon compound, a compound having one or more cyclohexyl ring and preferably 10 to 45 carbon atoms, more preferably 10 to 24 carbon atoms, much more preferably 14 to 22 carbon atoms in total may be used.

Specific examples of the synthetic alicyclic hydrocarbon compound include octylcyclohexane, decylcyclohexane, dodecylcyclohexane, tetradecylcyclohexane, dibutylcyclohexane, and dihexylcyclohexane.

As the synthetic aromatic hydrocarbon compound, a compound having a linear alkyl group on an aromatic ring and preferably 10 to 45 carbon atoms, more preferably 10 to 24 carbon atoms, much more preferably 14 to 22 carbon atoms in total may be used.

The number of the linear alkyl groups on the aromatic ring may be one group, or two or more groups which are the same as or different from each other.

Specific examples of the synthetic aromatic hydrocarbon compound include octylbenzene, decylbenzene, dodecylbenzene, tetradecylbenzene, hexadecylbenzene, dibutylbenzene, dipentylbenzene, dihexylbenzene, diheptylbenzene, and dioctylbenzene.

In the present invention, one kind or two or more kinds selected from the hydrocarbon-based base oils is used as the hydrocarbon-based base oil to ensure that the kinematic viscosity at 40° C. of the base oil becomes 1 to 8 $mm^2/s$, preferably 1 to 6 $mm^2/s$, more preferably 2 $mm^2/s$ or more and less than 5 $mm^2/s$, and particularly preferably 2.5 to 4.5 $mm^2/s$.

The refrigerating machine oil of the present invention may contain at least one additive selected from an extreme-pressure agent, oiliness agent, an antioxidant, an acid scavenger, and an antifoaming agent.

Examples of the extreme-pressure agent include phosphorus-based extreme-pressure agents formed of phosphates, acidic phosphates, phosphites, acidic phosphites, or amine salts thereof.

Of those phosphorus-based extreme-pressure agents, tricresyl phosphate, trithiophenyl phosphate, tri(nonylphenyl) phosphite, dioleyl hydrogen phosphite, and 2-ethylhexyldiphenyl phosphite are particularly preferred from the viewpoints of extreme pressure property and frictional characteristics.

A metal salt of a carboxylic acid may also be used as the extreme-pressure agent. The metal salt of a carboxylic acid is preferably a metal salt of a carboxylic acid having 3 to 60 carbon atoms, more preferably a metal salt of a fatty acid having 3 to 30 carbon atoms, specifically 12 to 30 carbon atoms. Examples of the extreme-pressure agent include metal salts of dimer acid and trimer acid of the fatty acid and metal salts of a dicarboxylic acid having 3 to 30 carbon atoms. Of those, metal salts of a fatty acid having 12 to 30 carbon atoms and metal salts of a dicarboxylic acid having 3 to 30 carbon atoms are particularly preferred.

Meanwhile, an alkali metal or alkali earth metal is preferred and an alkali metal is particularly preferred as a metal constituting the metal salt.

Further, example of extreme-pressure agents other than the ones mentioned above include sulfur-based extreme-pressure agents formed of sulfurized oil and fat, fatty acid sulfides, sulfide esters, sulfide olefins, dihydrocarbyl polysulfides, thiocarbamates, thioterpenes, or dialkylthio dipropionates.

The amount of the extreme-pressure agent is generally 0.001 to 5 mass %, particularly preferably 0.005 to 3 mass % based on the total amount of the composition from the viewpoints of lubricity and stability.

The extreme-pressure agents may be used alone or in combination of two or more.

Examples of the oiliness agent include: aliphatic saturated or unsaturated monocarboxylic acids such as stearic acid and oleic acid; polymers of fatty acid such as dimer acid and hydrogenated dimer acid; hydroxy fatty acids such as ricinoleic acid and 12-hydroxystearic acid; saturated or unsaturated fatty monoalcohols such as laurylalcohol and oleylalcohol; saturated or unsaturated fatty monoamines such as stearylamine and oleylamine; saturated or unsaturated fatty monocarboxylic amides such as lauric acid amide and oleic acid amide; and partially esters of polyalcohols such as glycerine and sorbitol and saturated or unsaturated aliphatic monocarboxylic acid.

They may be used alone or in combination of two or more. The amount of the oiliness agent is generally 0.01 to 10 mass %, preferably 0.1 to 5 mass based on the total amount of the composition.

Examples of the antioxidant include: phenol-based antioxidants formed of 2,6-di-tert-butyl-4-methylphenol, 2,6-di-tert-butyl-4-ethylphenol, and 2,2'-methylenebis(4-methyl-6-tert-butylphenol); and amine-based antioxidants formed of phenyl-α-naphthylamine and N,N'-di-phenyl-p-phenylenediamine. The antioxidant is contained in the composition in an amount of generally 0.01 to 5 mass %, preferably 0.05 to 3 mass % from the viewpoints of efficacy and economic efficiency.

As the acid scavenger, for example, phenylglycidylether, alkylglycidylether, alkyleneglycol glycidylether, cyclohexeneoxide, α-olefinoxide, and an epoxy compound such as epoxidized soybean oil are mentioned. Of those, phenylglycidylether, alkylglycidylether, alkyleneglycol glycidylether, cyclohexeneoxide, and α-olefinoxide are preferred from the viewpoint of compatibility.

The alkyl group of the alkyl glycidyl ether and the alkylene group of the alkylene glycol glycidyl ether may have a branch and have generally 3 to 30, preferably 4 to 24, and particularly preferably 6 to 16 carbon atoms. An α-olefin oxide having 4 to 50, preferably 4 to 24, and particularly preferably 6 to 16 carbon atoms in total is used as the α-olefin oxide. In the present invention, the acid scavengers may be used alone or in combination of two or more. The amount of the acid scavenger is generally 0.005 to 5 mass %, and particularly preferably 0.05 to 3 mass % based on the composition from the viewpoints of efficacy and the suppression of the production of sludge.

In the present invention, the stability of the refrigerating machine oil can be improved by using the acid scavenger. The effect of further improving the stability is obtained by using the extreme-pressure agent and antioxidant in combination with the acid scavenger.

Examples of the antifoaming agent include silicone oil and fluorinated silicone oil.

Other known additives such as a copper inactivating agent exemplified by N—[N,N'-dialkyl (alkyl group having 3 to 12 carbon atoms) aminomethyl]tolytriazole may be suitably added to the refrigerating machine oil of the present invention in a range not inhibiting the object of the present invention.

The refrigerating machine oil of the present invention is used in refrigerators using a hydrocarbon-based, carbon dioxide-based, hydrofluorocarbon-based, or ammonia-based refrigerant, especially refrigerators using a hydrocarbon-based refrigerant.

As for the amounts of the refrigerant and the refrigerating machine oil in the method of lubricating a refrigerator using the refrigerating machine oil of the present invention, the mass ratio of the refrigerant to the refrigerating machine oil is 99/1 to 10/90, preferably 95/5 to 30/70. When the amount of the refrigerant falls below the above range, a reduction in refrigerating capability is observed and when the amount exceeds the above range, lubricating performance degrades disadvantageously, which are not preferable. Although the refrigerating machine oil of the present invention can be used in various refrigerators, it is preferably used in the compression refrigeration cycle of a compression refrigerator.

The refrigerator in which the refrigerating machine oil of the present invention is used has a refrigeration cycle essentially composed of: a compressor, a condenser, an expansion mechanism (such as an expansion valve), and an evaporator; or a compressor, a condenser, an expansion mechanism, a drier, and an evaporator. The refrigerator in which the refrigerating machine oil of the present invention is used uses the refrigerating machine oil of the present invention as a refrigerating machine oil and the above refrigerant as a refrigerant.

A desiccant formed of zeolite having a pore diameter of 0.33 nm or less is preferably charged into the drier. Examples of the zeolite include natural zeolite and synthetic zeolite. Further, the zeolite preferably has a $CO_2$ gas absorption capacity of 1.0% or less at 25° C. and at a $CO_2$ gas partial pressure of 33 kPa. Examples of the synthetic zeolite include the XH-9 and XH-600 (trade names) manufactured by Union Showa Co., Ltd.

In the present invention, use of the desiccant makes it possible to remove water efficiently and suppress powderization caused by the deterioration of the desiccant itself at the same time without absorbing the refrigerant in the refrigeration cycle. Therefore, there is no possibility of the blockage of a pipe caused by powderization and abnormal abrasion caused by entry into the sliding part of a compressor, thereby making it possible to operate the refrigerator stably for a long time.

Various sliding parts (such as bearing) are present in a compressor in a refrigerator to which the refrigerating machine oil of the present invention is applied. In the present invention, a part formed of engineering plastic, or a part having an organic or inorganic coating film is used as each of the sliding parts in terms of, in particular, sealing property.

Preferable examples of the engineering plastic include a polyamide resin, a polyphenylene sulfide resin, and a polyacetal resin in terms of sealing property, sliding property, and abrasion resistance.

In addition, examples of the organic coating film include a fluorine-containing resin coating film (such as polytetrafluoroethylene coating film), a polyimide coating film, and a polyamideimide coating film in terms of sealing property, sliding property, and abrasion resistance.

On the other hand, examples of the inorganic coating film include a graphite film, a diamond-like carbon film, a nickel film, a molybdenum film, a tin film, and a chromium film in terms of sealing property, sliding property, and abrasion resistance. The inorganic coating film may be formed by a plating treatment or a physical vapor deposition method (PVD).

The refrigerating machine oil of the present invention may be used in car air-conditioners, gas heat pumps, air-conditioners, cool storages, automatic vending machines, show cases, hot water supply systems, or refrigerating and heating systems.

In the present invention, the water content in the system is preferably 600 ppm by mass or less, more preferably 50 ppm by mass or less. The amount of the residual air in the system is preferably 8 kPa or less, more preferably 7 kPa or less.

The refrigerating machine oil of the present invention contains a mineral oil, a synthetic alicyclic hydrocarbon compound, or a synthetic aromatic hydrocarbon compound as a main component of its base oil, can improve energy-saving performance due to its low viscosity and has excellent sealing property.

EXAMPLES

The following examples are provided for the purpose of further illustrating the present invention but are in no way to be taken as limiting.

The properties of the base oil and the properties of the refrigerating machine oil were obtained by the following procedures.

<Properties of Base Oil>

(1) 40° C. Kinematic Viscosity

This was measured with a glass capillary type viscometer in accordance with JIS K2283-1983.

(2) Flash Point

This was measured by a C.O.C. method in accordance with JIS K2265.

<Properties of Refrigerating Machine Oil>

(3) Frictional Coefficient

This was measured in an atmosphere with an R600a (isobutane) at 1 MPa by a closed block-on-ring tester.

(4) Actual Machine Durability Test

Each sliding material was used in the piston of a Scotch York type compressor to carry out an actual machine durability test in order to measure a temperature rise in the compressor caused by blow-by from the space between the piston and the cylinder. "Good" in the criteria means that the risen temperature is in the range of the setting temperature ±20° C. "Baking" means that the amount of blow-by is large and the temperature rises to cause baking.

Examples 1 to 6 and Comparative Examples 1 and 2

The refrigerating machine oil having compositions shown in Table 1 were prepared, the friction tests were performed to obtain frictional coefficients, and an actual machine durability test was performed. The results are shown in Table 1.

TABLE 1

| | | | Example 1 Sample Oil 1 | Example 2 Sample Oil 2 | Example 3 Sample Oil 3 | Example 4 Sample Oil 4 |
|---|---|---|---|---|---|---|
| | Sample oil No. | | | | | |
| Amount (mass %) | Base oil | A1 | 100 | | Balance | |
| | | A2 | | 100 | | Balance |
| | | A3 | | | | |
| | | A4 | | | | |
| | Extreme-pressure agent | B1 | | | 1 | 1 |
| | Acid scavenger | B2 | | | 1 | 1 |
| | Antioxidant | B3 | | | 0.5 | 0.5 |
| | Antifoaming agent | B4 | | | 0.001 | 0.001 |
| Sliding material | | | Cl | C2 | C3 | C4 |
| Frictional coefficient | | | 0.12 | 0.07 | 0.06 | 0.08 |
| Result of actual machine durability test | | | Good | Good | Good | Good |

| | | | Example 5 Sample oil 5 | Example 6 Sample oil 6 | Comparative Example 1 Sample oil 1 | Comparative Example 2 Sample oil 2 |
|---|---|---|---|---|---|---|
| | Sample oil No. | | | | | |
| Amount (mass %) | Base oil | A1 | | | 100 | |
| | | A2 | | | | 100 |
| | | A3 | 100 | | | |
| | | A4 | | 100 | | |
| | Extreme-pressure agent | B1 | | | | |
| | Acid scavenger | B2 | | | | |
| | Antioxidant | B3 | | | | |
| | Antifoaming agent | B4 | | | | |

TABLE 1-continued

| Sliding material | C1 | C1 | C5 | C6 |
|---|---|---|---|---|
| Frictional coefficient | 0.13 | 0.15 | 0.28 | 0.37 |
| Result of actual machine durability test | Good | Good | Baking | Baking |

[Note]

A1: paraffin-based mineral oil, kinematic viscosity at 40° C. = 2.86 $mm^2/s$, S minute(s) = 0.001 mass %, flash point = 110° C., average molecular weight = 230, molecular weight distribution (variance ratio) = 1.8

A2: naphthene-based mineral oil, kinematic viscosity at 40° C. = 3.12 $mm^2/s$, S minute (s) = 0.01 mass %, flash point = 117° C., average molecular weight = 224, molecular weight distribution (variance ratio) = 1.5

A3: n-dodecylcyclohexane, kinematic viscosity at 40° C. = 4.82 $mm^2/s$, flash point = 147° C., average molecular weight = 252.5, molecular weight distribution (variance ratio) = 1

A4 : n-dodecylbenzene, kinematic viscosity at 40° C. = 3.89 $mm^2/s$ , flash point = 141° C., average molecular weight = 246.4, molecular weight distribution (variance ratio) = 1

B1: tricresylphosphate

B2: 2-ethylhexylglycidyl ether

B3: 2,6-di-t-butyl-4 -methylphenol

B4: silicone-based antifoaming agent

C1: polyphenylene sulfide

C2: fluorine-containing polymer coating film

C3: polyimide-containing coating film

C4: tin plating film

C5: aluminum alloy

C6: iron alloy

It is understood from Table 1 that the refrigerating machine oils of the present invention (Examples 1 to 6) have a lower frictional coefficient than those of Comparative Examples 1 and 2 and good result of the actual machine durability test. In Comparative Examples 1 and 2, baking occurred between the piston and the cylinder in the actual machine durability test.

INDUSTRIAL APPLICABILITY

The refrigerating machine oil of the present invention can improve energy-saving performance due to its low viscosity, has low frictional coefficient and high sealing property, and is suitably used in various refrigeration applications, especially in closed-type refrigerators.

The invention claimed is:

1. A method of lubricating a sliding part formed from an engineering plastic or comprising an organic coating film or an inorganic film in a refrigerator, comprising contacting the sliding part with a refrigerating machine oil, wherein the refrigerating machine oil comprises a base oil which contains a mineral oil as a main component, wherein the base oil has a kinematic viscosity at 40° C. of 1 to 3.12 $mm^2/s$, and the refrigerator uses a hydrocarbon-based refrigerant.

2. The method of claim 1, wherein the base oil has a molecular weight of 140 to 660.

3. The method of claim 1, wherein the base oil has a flash point of 100° C. or higher.

4. The method of claim 1, wherein the refrigerating machine oil comprises at least one additive selected from the group consisting of an extreme-pressure agent, an oiliness agent, an antioxidant, an acid scavenger and an antifoaming agent.

5. The method of claim 1, wherein the organic coating film on the sliding part of the refrigerator comprises a polytetrafluoroethylene coating film, a polyimide coating film, or a polyamide-imide coating film.

6. The method of claim 1, wherein the inorganic coating film on the sliding part of the refrigerator comprises a graphite film, a diamond-like carbon film, a tin film, a chromium film, a nickel film, or a molybdenum film.

7. The method of claim 1, wherein the sliding part has an organic coating film, and the organic coating film comprises a polytetrafluoroethylene coating film, a polyimide coating film or a polyamide-imide coating film.

8. The method of claim 1, wherein the sliding part has an inorganic coating film, wherein the inorganic coating film comprises a graphite film, a diamond-like carbon film, a tin film, a chromium film, a nickel film or a molybdenum film.

9. The method of claim 1, wherein the base oil has a kinematic viscosity at 40° C. of 1 to 2.86 $mm^2/s$.

10. The method of claim 1, wherein the hydrocarbon-based refrigerant is isobutane.

11. The method of claim 1, wherein the content of mineral oil in the base oil is 90 mass % or more.

12. The method of claim 1, wherein the base oil further contains at least one selected from the group consisting of a hydrogenation products of an a-olefin oligomer, polyvinyl ethers, polyoxyalkylene glycol derivatives, and ether compounds.

* * * * *